US008459087B2

(12) United States Patent
König

(10) Patent No.: US 8,459,087 B2
(45) Date of Patent: Jun. 11, 2013

(54) METHOD FOR PRODUCING EMBOSSED BLANKS

(75) Inventor: Roman König, Weinburg (AT)

(73) Assignee: Constantia Teich GmbH (AT)

( * ) Notice: Subject to any disclaimer, the term of this patent is extended or adjusted under 35 U.S.C. 154(b) by 0 days.

(21) Appl. No.: 13/375,198

(22) PCT Filed: Jun. 7, 2010

(86) PCT No.: PCT/AT2010/000198

§ 371 (c)(1),
(2), (4) Date: Nov. 29, 2011

(87) PCT Pub. No.: WO2011/000005

PCT Pub. Date: Jan. 6, 2011

(65) Prior Publication Data

US 2012/0073352 A1 Mar. 29, 2012

(30) Foreign Application Priority Data

Jun. 30, 2009 (AT) ..... 1017/2009

(51) Int. Cl.
*B23P 19/00* (2006.01)
*B21D 5/00* (2006.01)
*B21D 35/00* (2006.01)

(52) U.S. Cl.
USPC ..... 72/379.2; 72/379.6; 72/414; 83/55

(58) Field of Classification Search
USPC ..... 72/31.1, 37, 325, 335, 379.2, 379.6, 72/461, 414; 83/897.2, 55
See application file for complete search history.

(56) References Cited

U.S. PATENT DOCUMENTS

| | | | | |
|---|---|---|---|---|
| 2,823,029 | A * | 2/1958 | Ford et al. | 226/32 |
| 4,725,111 | A * | 2/1988 | Weitzen et al. | 359/12 |
| 5,009,093 | A * | 4/1991 | Quinn et al. | 72/177 |
| 5,359,766 | A * | 11/1994 | Pavely et al. | 29/796 |
| 6,662,618 | B2 * | 12/2003 | Wong | 72/379.2 |

FOREIGN PATENT DOCUMENTS

| | | | |
|---|---|---|---|
| DE | 101 01 860 | C1 | 4/2002 |
| GB | 848 748 | A | 9/1960 |
| JP | 60 166132 | A | 8/1985 |
| WO | 99/29508 | A1 | 6/1999 |

OTHER PUBLICATIONS

International Search Report and Written Opinion dated Oct. 27, 2010 in connection with related PCT Application No. PCT/AT2010/000198.

* cited by examiner

*Primary Examiner* — David B Jones
(74) *Attorney, Agent, or Firm* — Kolisch Hartwell, P.C.

(57) ABSTRACT

The invention relates to a method for producing a blank, which is composed at least substantially of material that can be embossed, in particular aluminum or an aluminum alloy, for closing a container along the edge thereof, in particular by means of adhesive bonding or sealing, the blank having an embossed surface and being stamped from a continuous material. The invention is characterized in that markings are embossed on the continuous material when the surface of the blank is embossed, said markings being used for the position determination during the stamping process.

18 Claims, 2 Drawing Sheets

METHOD FOR PRODUCING EMBOSSED BLANKS

The invention relates to a method for producing embossed blanks in accordance with the preamble of claim 1.

In this application, embossed blanks are understood as being blanks which consist at least substantially of embossable material, in particular aluminum or an aluminum alloy. In the context of the application, embossable material is also composite material (laminated or coextruded) which contains an aluminum layer, in combination with paper and/or plastic, but also what are known as nonaluminum blanks which consist of plastic, plastic composite, paper, paper composite (usually with plastic), etc. What is essential for the invention is only its embossability which a person skilled in the art usually already recognizes from the construction of the blank, but at least can determine using some simple tests.

As long as their material is not itself capable of being sealed, the blanks have a layer of material which can be sealed on their surface which faces the container which they are intended to close. They can have a print, or not, on the outwardly directed surface, and they can ultimately be composed of a plurality of layers which are connected to one another over their full surface area, as long as the endless material which is obtained in this way is embossable. For embossing, the endless material, from which the blanks are punched, is guided in the course of its production between two what are known as embossing rolls with a respectively contoured surface and is thus provided itself with the embossing.

Here, the height of the contours is small even in comparison with the low thickness of the blank material, in general only up to 10%, in some cases 50% and in special cases up to 100% or else more of the thickness of the blank. That surface of the endless material which is smooth from the preceding rolling is usually deformed over its full surface area with a very small-area repeating pattern in such a way that it appears matt to the eye, and the regions, such as symbols, company logos, product names, etc. which are to be readily detectable by the observer (in summary: called the "motif"), are omitted from the embossing in such a way that the original, smooth roll surface of the film is retained in these regions.

The embossed film which is produced in this way can then either be rolled up again into the store or is fed immediately to the punching station, in which the blanks are punched out of the endless material and are pushed into a stack container, in which they are later delivered to the filler.

Since these embossed blanks were originally intended to be a visual equivalent to the winding films, as have already been customary for a long time, in particular, for chocolate, these visual elements were also relatively small in comparison with the surface area of the blanks, covered the entire endless web, and the position of the punched edge in comparison with the endless material was not critical. Lately, it has proven to be desirable to provide blanks with large format images, lettering, etc. and to predefine the blank edge during embossing by it being left smooth without embossing. Firstly, this increases the sealing quality at the container edge even if the contouring during embossing, as mentioned above, is only minimal; secondly, the appearance of the motif is improved considerably as a result. This then produces the problem that the endless web has to be stopped at precisely the correct point in front of the (or in the) punching die, in order to make the punching of the blank out of the endless material possible in accordance with the embossed motif and, in particular, the blank edge.

In the prior art, the procedure for producing the embossed blanks mentioned in the introduction has been that first of all a marking was printed onto the endless web, that the embossing was performed in a positionally correct manner with respect to the marking, with or without a printed motif, and that finally the marking has also been used to control the punch. This is not a problem in the case of blanks which are both printed and embossed, but in the case of the blanks which are only embossed, as are in demand increasingly on account of their appearance, the printing of only the marking signifies a separate work step, the costs of which are to be avoided if possible.

JP 60 166 132 A which relates to blanks comprising two aluminum layers, one of which is to be perforated in specific regions, in order to weaken the final product there, which is therefore not of the generic type, proposes punching out holes with utmost precision in the edge region of the first endless, perforated aluminum web. As a result, they can be detected optically after the lamination with plastic and the second aluminum web, and permit positionally accurate punching out of the double web with regard to the perforations of the first web.

GB 848,748 A which relates to punching out crown cap blanks which have already been provided previously with motifs from an aluminum web with as little waste as possible, which is therefore likewise not of the generic type, provides for recesses to be punched out (even before printing?) at suitable points in the edge region of the aluminum web, which recesses are detected mechanically or optically by the actual punching machine and are used to position the web.

In these methods, the problem then occurs that the material web has to be guided twice through a punching apparatus, the first time for applying the positioning marks for the subsequent embossing and the second time for the actual, ultimate punching out of the product. This entails an even greater additional outlay than in the case of printed webs, since the subsequent rolling up and storing of the mechanically loaded band is not as unproblematic as that of the printed webs.

There is therefore still a requirement for markings which can be applied without an additional punching or printing step.

According to the invention, to this end, it is proposed in accordance with the features which are specified in the characterizing part of claim 1 to produce a marking at a suitable point on the embossing rolls by the repeating pattern being interrupted, as in the case of the other smooth points of the blank, with the result that an optically detectable marking is formed.

The formation of this smooth point can be produced by mechanical removal of the repeating pattern which was originally usually applied to the embossing rolls in a mechanical way; the removal by means of acid after covering the regions which remain matt, during the production of the embossing rolls, is also possible.

The difference in the reflection between the matted and the smooth points is only a few percent when measured with a measuring instrument; it is therefore surprising that optical measuring instruments which are used to detect the striking markings which are printed in black are also capable of detecting embossed markings of this type.

The markings themselves can assume or have all shapes and forms as the markings in the prior art; that is to say, they can be simple bars, they can be relatively thin lines which are crossed or are offset with respect to one another or intersect one another, and the like.

The smooth blank material which is present rolled up in the form of an endless web is therefore guided through between two embossing rolls, the embossings being applied and the motifs being left free; here, optically detectable markings which are arranged outside the blanks to be punched out as a result are also provided by corresponding formation of the surface of the embossing rolls, and said markings are used during punching out of the blanks for the correct positioning of the endless web with regard to the punching die.

All the embossable materials which are also suitable for the blank production can be subjected to the method according to the invention.

Figure 1:
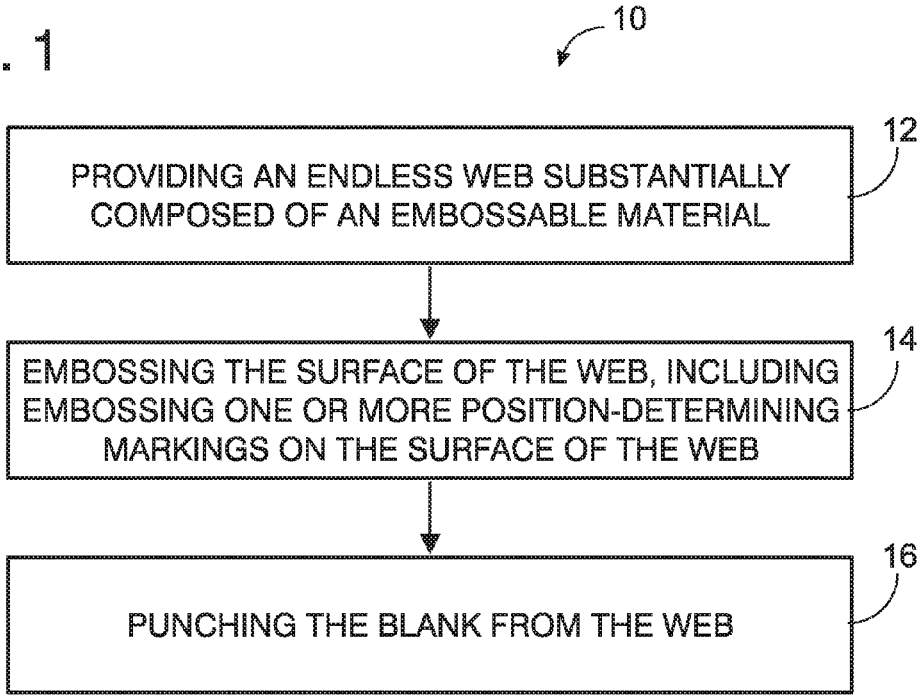
FIG. 1 is a flowchart depicting a method of producing a blank having an embossed surface according to one embodiment of the invention.

A method of producing a blank having an embossed surface according to the present invention is set out in flowchart 10 of FIG. 1. The method includes providing an endless web substantially composed of an embossable material, at 12; embossing the surface of the web, including embossing one or more position-determining markings on the surface of the web, at 14; and punching the blank from the web, at 16.

Figure 2:
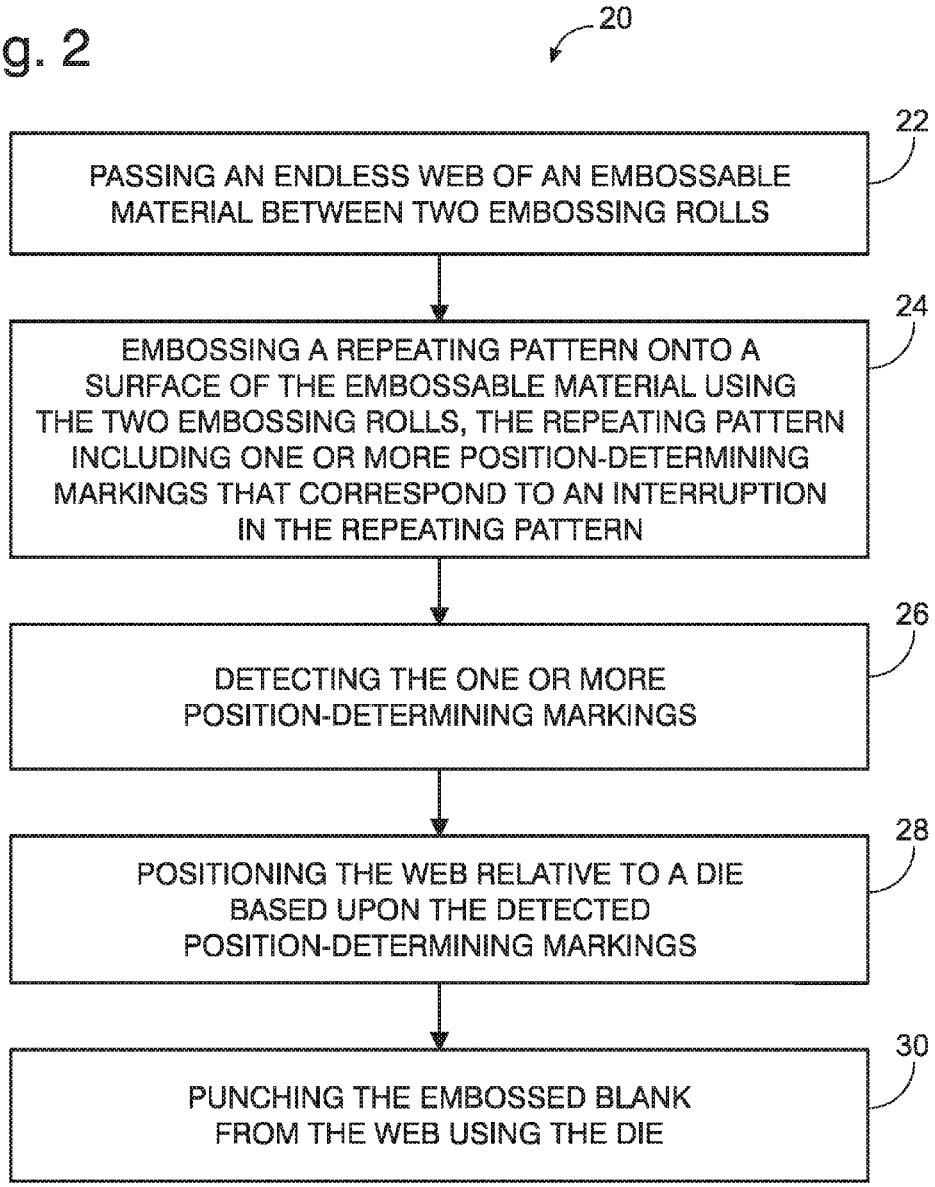
FIG. 2 is a flowchart depicting a method of producing an embossed blank according to an alternative embodiment of the invention.

A method of producing an embossed blank is set out in flowchart 20 of FIG. 2. The method includes passing an endless web of an embossable material between two embossing rolls, at 22; embossing a repeating pattern onto a surface of the embossable material using the two embossing rolls, where the repeating pattern includes one or more position-determining markings that correspond to an interruption in the repeating pattern, at 24; detecting the one or more position-determining markings, at 26; positioning the web relative to a die based upon the detected position-determining markings, at 28; and punching the embossed blank from the web using the die, at 30.

Even if the description always talks of the production of the embossing by way of embossing rolls and this is also probably the most frequent type of production, the invention is not restricted thereto, but rather can also be used in the application of the embossing by plates or also by lasers.

It is significant that a complete omission of printing media and therefore liquids and pigments in the region of the impending blank becomes possible as a result of the invention, which is desirable in many cases, in particular also in the field of pharmaceuticals.

The invention claimed is:

1. A method of producing a blank having an embossed surface, comprising:

providing an endless web substantially composed of an embossable material;

embossing the surface of the web; and punching the blank from the web;

wherein embossing the surface of the web includes embossing one or more position-determining markings on the surface of the web.

2. The method of claim 1, wherein embossing the surface of the web includes embossing the one or more position-determining markings on the surface of the web between two embossing rolls.

3. The method of claim 2, wherein the one or more position-determining markings on the surface of the web are configured to assist in positioning the endless web with regard to the punching die during the punching of the blank.

4. The method of claim 3, wherein applying one or more position-determining markings includes embossing one or more optically detectable markings.

5. The method of claim 4, wherein the one or more optically detectable markings on the surface of the web correspond to a smooth point on an otherwise matt surface.

6. The method of claim 1, wherein punching the blank from the web includes detecting a one or more position-determining markings; positioning the web based upon the detected marking, and punching the blank from the web using a die.

7. The method of claim 1, wherein the embossable material of the provided web includes aluminum or an aluminum alloy.

8. The method of claim 1, wherein the embossable material of the provided web includes a composite material that includes a layer of aluminum or aluminum alloy.

9. The method of claim 1, wherein punching the blank from the web includes punching a blank that is configured to close a container.

10. The method of claim 9, wherein punching the blank from the web includes punching a blank configured to be sealed along an edge of the container using an adhesive.

11. The method of claim 1, wherein neither embossing the surface of the web nor punching the blank from the web requires either liquids or pigments, and the resulting embossed blank is substantially free of printing.

12. The method of claim 1, wherein embossing one or more position-determining markings to the surface of the web includes embossing the position-determining markings on an area of the surface of the web located outside the area of the web configured to be punched to produce the blank.

13. The method of claim 2, wherein a surface of at least one of the embossing rolls includes a repeating embossing pattern, and the one or more position-determining markings on the surface of the web correspond to an interruption in the repeating embossing pattern.

14. The method of claim 13, wherein the interruption in the repeating embossing pattern is produced by mechanically removing a portion of the embossing pattern on the surface of the embossing roll.

15. The method of claim 13, wherein the interruption in the repeating embossing pattern is produced by chemically removing a portion of the embossing pattern on the surface of the embossing roll.

16. A method of producing an embossed blank, comprising:

passing an endless web of an embossable material between two embossing rolls;

embossing a repeating pattern onto a surface of the embossable material using the two embossing rolls; wherein the repeating pattern includes one or more position-determining markings that correspond to an interruption in the repeating pattern;

detecting the one or more position-determining markings;

positioning the web relative to a die based upon the detected position-determining markings; and punching the embossed blank from the web using the die.

17. The method of claim 16, wherein the web of embossable material includes a layer of aluminum or aluminum alloy.

18. The method of claim 16, wherein the container includes an opening defined by an edge, and the embossed blank is configured to close the container along its edge by adhesive bonding or sealing.

* * * * *